US007816994B2

(12) United States Patent
Maat

(10) Patent No.: US 7,816,994 B2
(45) Date of Patent: Oct. 19, 2010

(54) MICROWAVE CIRCULATOR WITH THIN-FILM EXCHANGE-COUPLED MAGNETIC STRUCTURE

(75) Inventor: Stefan Maat, San Jose, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 183 days.

(21) Appl. No.: 12/260,001

(22) Filed: Oct. 28, 2008

(65) Prior Publication Data

US 2010/0102896 A1 Apr. 29, 2010

(51) Int. Cl.
*H01P 1/387* (2006.01)
*H01P 1/38* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 5,384,556 | A | 1/1995 | Coles et al. | |
| 6,141,571 | A * | 10/2000 | Dionne | 505/210 |
| 7,170,362 | B2 | 1/2007 | Kingston et al. | |
| 2006/0226926 | A1 | 10/2006 | Chui | |

OTHER PUBLICATIONS

Zahwe et al., "Towards a Miniaturized Circulator With Magnetic Thin Film", Procedings of the 37th European Microwave Conference, Oct. 2007, Munich Germany, pp. 274-277.

How et al., "Theory and Experiment of Thin-Film Junction Circulator", IEEE Transactions on Microwave Theory and Techniques, vol. 46, No. II, Nov. 1998, pp. 1645-1653.

Kunar et al., 'Determination of exchange and rotational anisotrophies in IrMn/Fe(t)/IrMn exchange coupled structures using dynamic and static techniques: Application to microwave devices', Journal of Applied Physics 103, 07C107, 2008.

How et al., "Design of Drop-In Microstrip Circulator", 1'F.F. Traksactions on M,'.(iht.TICS. vol. 31. No. 2. hIARCH 1995, pp. 997-1002.

Stonies et al., "Time domain analysis and design of lumped element circulators", IEEE Microwave Symposium Digest, 2006, IEEE MTT-S International, Jun. 11-16, 2006, pp. 544-547.

* cited by examiner

*Primary Examiner*—Stephen E Jones
(74) *Attorney, Agent, or Firm*—Thomas R. Berthold

(57) ABSTRACT

A microwave circulator uses a thin-film exchange-coupled structure to provide an in-plane magnetic field around the circulator. The exchange-coupled structure is a ferromagnetic layer having an in-plane magnetization oriented generally around the circulator and an antiferromagnetic layer exchange-coupled with the ferromagnetic layer that provides an exchange-bias field to the ferromagnetic layer. A plurality of electrically conductive ports are connected to the exchange-coupled structure. Each of the portions or legs of the circulator between the ports may have an electrical coil wrapped around it with each coil connected to an electrical current source. The ferromagnetic resonance (FMR) frequency of the exchange-coupled structure in the absence of an external magnetic field is determined by the properties of the material of ferromagnetic layer and the magnitude of the exchange-bias field due to the exchange-coupling of the ferromagnetic layer to the antiferromagnetic layer. If one or more of the optional coils is used, then the FMR frequency can be tuned by changing the current in the coil or coils to change the magnitude of the externally applied magnetic field.

18 Claims, 5 Drawing Sheets

MICROWAVE CIRCULATOR WITH THIN-FILM EXCHANGE-COUPLED MAGNETIC STRUCTURE

BACKGROUND OF THE INVENTION

1. Field of the Invention

This invention relates generally to microwave circulators, and more particularly to a thin-film microwave circulator.

2. Description of the Related Art

A microwave circulator is a passive multiple-port electronic device that transfers microwave energy in a non-reciprocal way, for example in a 3-port device energy entering into port 1 predominantly exits port 2, energy into port 2 exits port 3, and energy into port 3 exits port 1. The selection of ports is arbitrary, and circulators can be made to circulate either clockwise (CW) or counterclockwise (CCW). Microwave circulators may be used as part of an antenna interface in a transmit/receive system. Energy can be made to flow from the transmitter (port 1) to the antenna (port 2) during transmit, and from the antenna (port 2) to the receiver (port 3) during receive.

Microwave circulators may be implemented in a planar configuration using stripline or microstrip technology which employ a planar resonating ferrite element between two ground plane conductors (stripline) or coupled to a single ground plane conductor (microstrip). A slab of bulk ferrite material of appropriate dimensions is placed in the center region of the circulator and is magnetized generally perpendicular to the ground plane of the circulator by an external magnet. The magnet can be either a permanent magnet or an electromagnet. In the case of an electromagnet an additional current supply is needed to energize its coils. The magnetization of the ferrite slab can then be switched and the circulator mode of operation can be modified from CW to CCW by switching the magnetization of the ferrite slab. The ferrite material is chosen to have a ferromagnetic resonance (FMR) frequency that generally matches the operational frequency of the microwave signal, to thereby provide a non-reciprocal transmission path between ports.

Because of the requirement for the bulk ferrite material and the permanent magnet, microwave circulators are not compatible with integration into small devices that require compactness and light weight. Moreover, the ferrite material limits the operating frequency of the circulator to the resonance frequency of the ferrite. Thus what is needed is a tunable microwave circulator that is compatible with compact, lightweight thin film design and that can easily be integrated into small devices.

SUMMARY OF THE INVENTION

The invention relates to a microwave circulator that uses a thin-film exchange-coupled structure to provide an in-plane magnetic field around the circulator. The circulator is a multilayered structure located between two ground planes and formed as a continuous closed loop with a generally triangular-like or ring-like shape. The exchange-coupled structure comprises a ferromagnetic layer having an in-plane magnetization oriented generally around the loop of the structure and an antiferromagnetic layer exchange-coupled with the ferromagnetic layer that provides an exchange-bias field to the ferromagnetic layer. Two antiferromagnetic layers may be used, with the ferromagnetic layer being located between the two antiferromagnetic layers to substantially increase the exchange-bias field to the ferromagnetic layer. A plurality of electrically conductive ports are connected to the multilayered structure at the vertices of the triangle if the structure has a triangular-like shape and at generally equally angularly spaced locations on the ring if the structure has a ring-like shape. Each of the portions or legs of the structure between the ports may have an electrical coil wrapped around it with each coil connected to an electrical current source. When one or more of the coils is energized an external additional magnetic field is generated in the plane of the ferromagnetic layer and around the circulator. The ferromagnetic resonance (FMR) frequency of the multilayered structure is determined by the properties of the material of ferromagnetic layer and the magnitude of exchange-bias field due to the exchange-coupling of the ferromagnetic layer to the antiferromagnetic layer or layers. However, if one or more of the optional coils is used, then the FMR frequency can be tuned by changing the current in the coil or coils to change the magnitude of the externally applied magnetic field.

For a fuller understanding of the nature and advantages of the present invention, reference should be made to the following detailed description taken together with the accompanying figures.

DETAILED DESCRIPTION OF THE INVENTION

Figure 1:
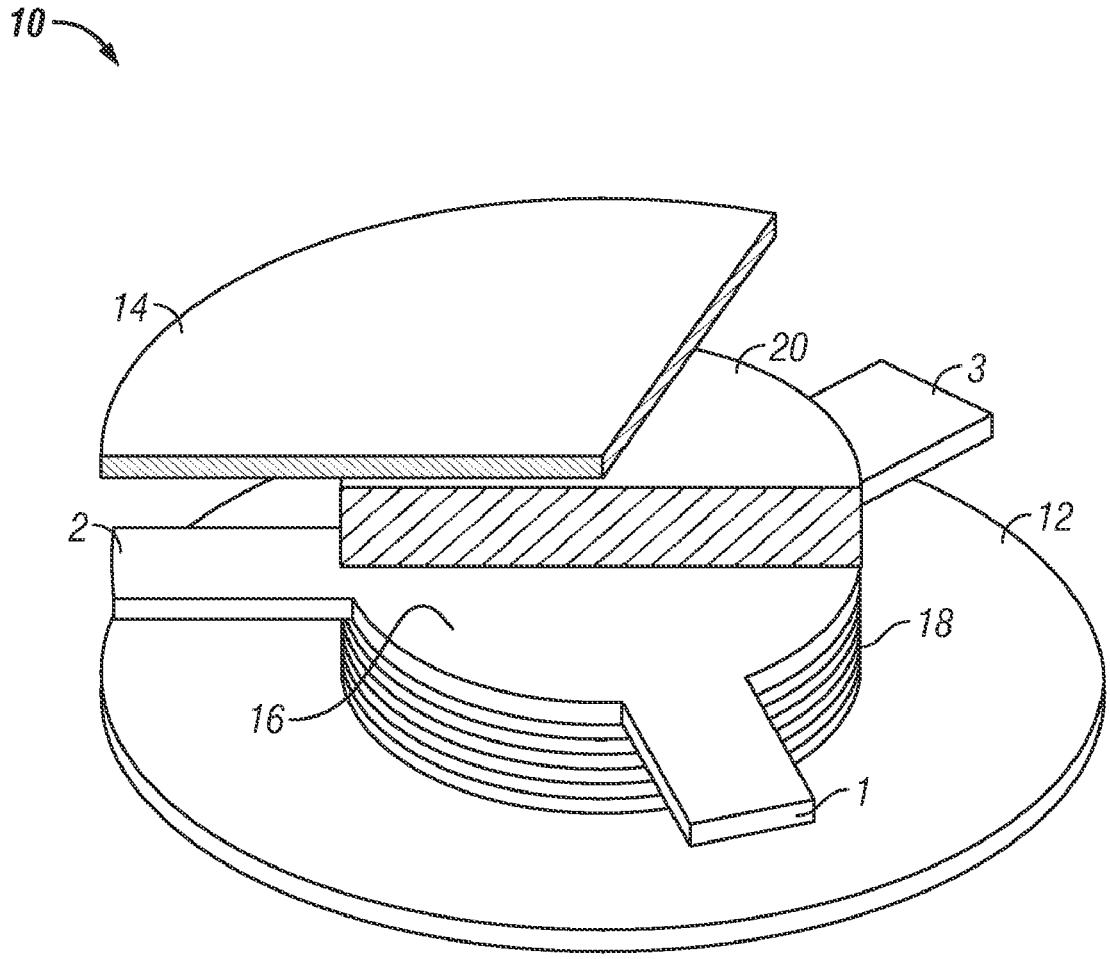
FIG. 1 (Prior Art)
FIG. 1 is an exploded isometric view of a conventional microwave circulator.

FIG. 1 is an exploded isometric view of a conventional microwave circulator 10. While the microwave frequency band is generally considered to be between about 0.3 GHz to 300 GHz, for purposes of this invention the microwave frequency range of interest is between about 5 GHz and 30 GHz. The circulator 10 includes first and second ground planes 12, 14, respectively, that are formed of conductive material, typically copper (Cu). A conductive element 16 has ports 1, 2 and 3 and is located between the ground planes 12, 14. A circular ferrite disc 18 is located between the conductive element 16 and the first ground plane 12, and a permanent magnet 20 is located between the conductive element 16 and the second ground plane 14. The ferrite disc 18 is magnetized by permanent magnet 20 that applies an external magnetic field perpendicular to the ferrite disc 18. The circulator 10 is non-reciprocal due to the Faraday effect. The properties of the ferrite disc 18 are selected so that its ferromagnetic resonance (FMR) frequency matches the operational frequency of the particular microwave application. Depending on the magnetization direction of magnet 20 the microwave signal input to one of the ports 1, 2 or 3 will travel clockwise or counterclockwise. Circulators are used as part of an antenna interface in a transmit/receive system. For example, microwave energy can be made to flow from the transmitter (port 1) to the antenna (port 2) during transmit, and from the antenna (port 2) to the receiver (port 3) during receive. If one of the ports is terminated by a matched load the circulator operates as an isolator since the signal can only travel in one direction between the remaining ports.

Figure 2A:
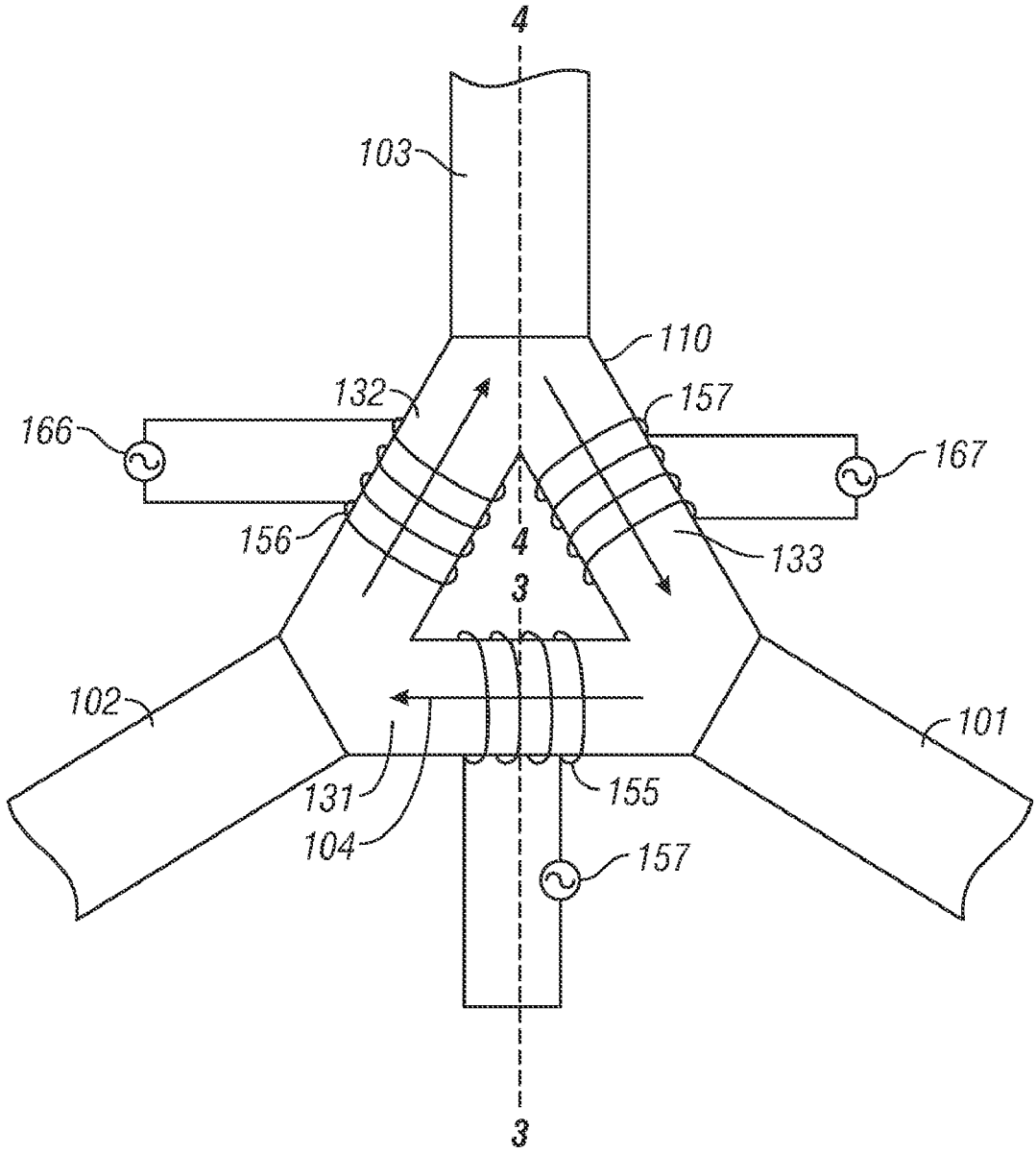
FIG. 2A is a top view of the circulator according to the invention with a triangular-like shape.
Figure 2B:
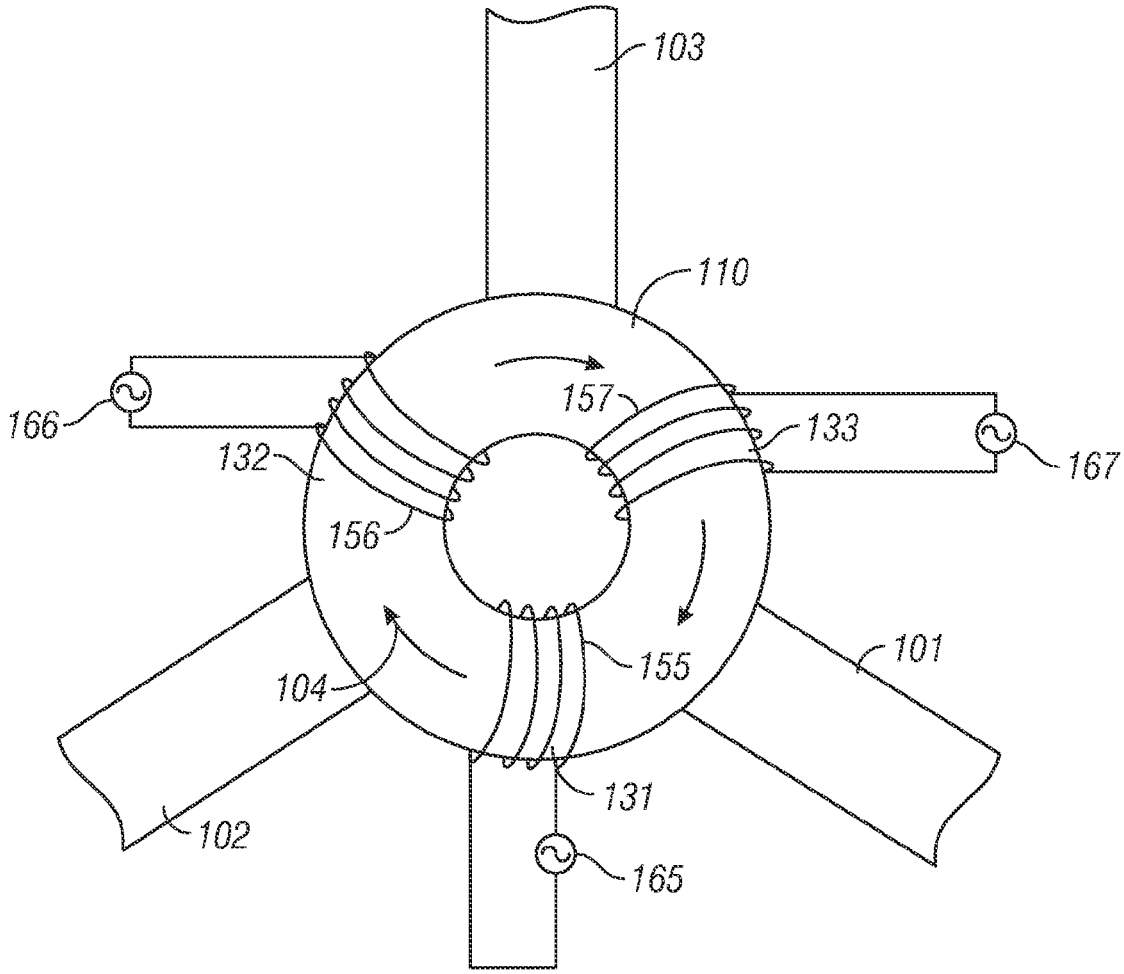
FIG. 2B is a top view of the circulator according to the invention with a ring-like shape.

FIG. 2A is a top view of the circulator according to the invention and shows a generally triangular-like structure 110 with three sections or legs 131, 132, 133. Where the legs connect to one another the structure 110 is connected to three stripline conductors 101, 102, 103 that function as the circulator ports. The structure 110 is shown as a triangular-like structure but may also be a ring-like structure with a generally circular or annular shape, in which case each leg 131, 132, 133 would have the shape of a circular arc or annular segment. FIG. 2B is a top view of the circulator according to the invention and shows a generally ring-like structure 110. In both the triangular-like and ring-like circulators the legs 131, 132, 133 are connected so as to form a continuous closed path and the stripline conductors 101, 102, 103 are generally equally-angularly spaced around the center of the structure 110.

The structure 110 is a multilayered structure patterned into the shape of a continuous closed loop or path, for example the triangular-shaped loop in FIG. 2A or the ring-shaped loop in FIG. 2B. The multilayered structure includes an exchange-biased ferromagnetic layer that is magnetized in a direction in the plane of and around path defined by the structure 110, as illustrated by arrow 104 oriented in the clockwise (CW) direction. Optional electrical coils 155, 156, 157 connected to respective current sources 165, 166, 167 are wrapped around respective legs 131, 132, 133. When one or more of the coils 155-157 is energized with current from current sources 165-167, additional magnetic fields are applied in the plane of and around the structure 110. The additional magnetic fields generated by the coils enable tunability of the resonance frequency, i.e., the operating frequency, of the circulator. This is in contrast to the conventional circulator of FIG. 1 with a ferrite slab wherein the operating frequency is fixed and determined by the material property of the ferrite.

The circulator structure 110 can be fabricated in a relatively wide range of sizes. A typical range for the dimensions would be for a triangular-like structure to have an outer dimension (or a ring-like structure to have an outer diameter) of about 5 to 20 mm and for the width of the legs (or the annular radial thickness for a ring-like structure) in the plane of the circulator to be in the range of about 0.5 to 2 mm.

Figure 3:
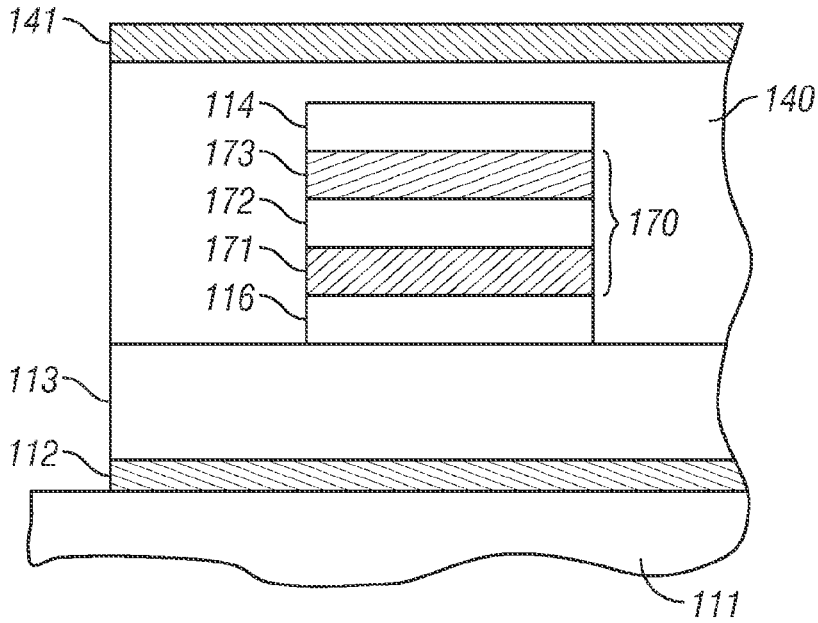
FIG. 3 is a sectional view of section A-A' of FIG. 2A.

FIG. 3 is a sectional view of section A-A' of FIG. 2A without the optional coil 155 and shows the layers making up the multilayered structure according to a preferred embodiment. An insulating substrate 111 is formed of any suitable material, such as silicon dioxide, aluminum-oxide, intrinsic silicon, intrinsic germanium or intrinsic gallium-arsenide, or a ceramic material. A first metallic ground plane 112 is deposited onto the substrate 111 followed by a first insulating gap layer 113. Suitable gap materials are silicon-oxide or aluminum oxide. An exchange-coupled structure 170 comprising antiferromagnetic layer 171 and ferromagnetic layer 172 is formed on the first gap layer 113. An optional seed layer 116 may be formed on the gap layer 113 to facilitate the growth the layers making up the exchange-coupled structure 170. The ferromagnetic layer 172 preferably is a layer consisting essentially of iron (Fe) and the antiferromagnetic layer 171 is preferably an iridium-manganese (IrMn) alloy. The antiferromagnetic layer 171 provides an exchange-bias field $H_{EX}$ to ferromagnetic layer 172. A typical seed layer 116 for IrMn is Ta/Cu, Ta/Ru, or just Cu or Ru. The exchange-coupled structure 170 may include an optional second antiferromagnetic layer 173 on top of ferromagnetic layer 172 to provide additional exchange-biasing. A capping layer 114, such as a layer of Ta, Al, Rh, Au, Pd, Pt, Ag, or Ru, may be deposited on top of the exchange-coupled structure 170 to prevent oxidation. The use of two antiferromagnetic layers 171, 173 on the opposite surfaces of ferromagnetic layer 172 will provide a greater exchange-bias field $H_{EX}$ than just a single antiferromagnetic layer. Alternatively, the first metallic ground plane 112 may be deposited onto the back of the substrate 111 and the exchange-coupled structure 170 deposited onto the front of the insulating substrate 111. In this case the insulating substrate 111 serves as the first gap layer 113.

The above described multilayered stack of layers 116, 170, 114 is then lithographically patterned to define the desired shape for the structure 110. Etching, such as reactive-ion-etching (RIE), or ion milling is then performed, followed by resist removal, leaving the structure with the desired triangular-like shape or ring-like shape. The structure 110 may then be back filled, for example with a second insulating gap layer 140 and then planarized for example by chemical-mechanical-polishing (CMP). Suitable materials for gap layer 140 include silicon-oxide and aluminum oxide. An optional second metallic ground plane 141, preferably a Cu layer, is formed on top of the second insulating gap layer 140. The layers are formed by typical thin film deposition techniques, such as magnetron sputtering, ion-beam deposition, evaporation, molecular chemical vapor deposition (MOCVD) or a combination of these techniques.

The ferromagnetic layer 172 is preferably Fe or a CoFe alloy with a thickness in the range of 3 nm to 15 nm. Although CoFe alloys may have a higher saturation magnetization and thus lead to higher FMR frequencies than Fe, they typically exhibit a broader linewidth, i.e., the full width at half maximum of the resonance frequency peak. The antiferromagnetic layers 171, 173 may each be a sufficiently thick Mn alloy layer (PtMn, NiMn, FeMn, IrMn, PdMn, PtPdMn or RhMn). A PtMn layer needs to be thicker than approximately 10 nm to become chemically-ordered and antiferromagnetic when annealed, and an IrMn layer is antiferromagnetic as deposited when it is thicker than approximately 4 nm. These antiferromagnetic Mn alloys may also include small amounts of additional elements, such as Cr, V, Pt, Pd and Ni that are typically added to improve corrosion resistance or increase electrical resistance. Other suitable materials for the antiferromagnetic layers 171, 173 are the known antiferromagnetic materials formed of a cobalt oxide, a nickel oxide, and an oxide of an alloy of cobalt and nickel.

The ferromagnetic layer 172 is exchange-biased by the antiferromagnetic layer 171 and will exhibit an enhanced uniaxial as well as a unidirectional anisotropy. Thus its M-H loop will exhibit an enhanced coercivity and be shifted by the exchange-bias field $H_{EX}$. The exchange-bias field $H_{EX}$ is determined by the magnetic coupling strength $J_A$ between the ferromagnetic layer 172 and the antiferromagnetic layer 171, and the thickness $t_F$ and magnetization $M_F$ of the ferromagnetic layer 172 according to the following equation:

$$H_{EX}=J_A/M_F t_F \qquad \text{Eq. (1)}$$

If the optional second antiferromagnetic layer 173 is used the value of the exchange-bias field will be greater than $H_{EX}$ in Eq. (1). If the thickness and material of antiferromagnetic layers 171 and 173 are identical then the value of the exchange-bias field should be doubled. However, due to differences in the microstructure of the two antiferromagnetic layers 171, 173 the exchange-bias field generated by the second antiferromagnetic layer 173 is typically less than that of the first antiferromagnetic layer 171. Thus the value of the exchange-bias field is typically less than $2*H_{EX}$ in Eq. (1).

In FIG. 3, the antiferromagnetic/ferromagnetic bilayer 171/172 is depicted with the antiferromagnetic layer 171 below the ferromagnetic layer 172. However, if the optional second antiferromagnetic layer 173 is not used, then the antiferromagnetic layer 171 may be located above ferromagnetic layer 172.

To establish an exchange-bias direction to the ferromagnetic layer the structure needs to be annealed at a temperature higher than the blocking temperature of the antiferromagnets 171, 173 in the presence of an external magnetic field oriented in the plane of the ferromagnetic layer 172 and in the circular direction 104 of the triangular-like or ring-like or structure 110. The blocking temperature is the temperature at which the exchange-coupling between the ferromagnetic layer 172 and the antiferromagnetic layers 171, 173 develops. This can be done, for example, by placing the structure on an arrangement or array of permanent magnets that have the same shape and geometry as the circulator. To establish exchange-bias, the structure is heated above and subsequently cooled below the blocking temperature in the presence of the magnetic field from the permanent magnets. For this the Curie temperature of the permanent magnets has to be higher than the blocking temperature of the antiferromagnets in order for them not to lose their magnetization direction.

For alloys like PtMn or NiMn to be used as antiferromagnets the annealing is also necessary not only to establish exchange-bias, but also to chemically order them. These alloys then undergo a paramagnetic-to-antiferromagnetic phase transition. Upon cooling from above to below the blocking temperature of the antiferromagnetic layers 171, 173, the magnetization direction of ferromagnetic layer 172 is set in the circular in-plane direction 104 and fixed by antiferromagnetic layers 171, 173. Alternatively, the ferromagnetic layer 172 and antiferromagnetic layers 171, 173 can be deposited at an elevated temperature above the blocking temperature so that chemical order in the antiferromagnetic layers 171, 173 is already induced during the deposition. The structure is then cooled from the deposition temperature through the blocking temperature in the presence of the external magnetic field from the permanent magnet array oriented in the plane of the ferromagnetic layer 172 and in the circular direction 104 of the triangular-like or ring-like structure.

Alternatively to an arrangement of permanent magnets, if the circulator is fabricated with optional coils 155-157, an electrical current can be supplied to the coils 155-157 via current sources 165-167, which also generates the desired magnetic field oriented in the plane of the ferromagnetic layer 172 and in the circular direction 104 of the triangular-like or ring-like or structure 110. To establish exchange-bias, the structure is heated above and subsequently cooled below the blocking temperature in the presence of the magnetic field from the electromagnets.

If a chemically disordered antiferromagnet like IrMn or FeMn is used for the antiferromagnetic layers 171, 173 then no annealing is necessary. These materials are antiferromagnetic as deposited. The ferromagnetic layer 172 and antiferromagnetic layers 171, 173 can be deposited in the presence of an external magnetic field oriented in the plane of the ferromagnetic layer 172 and in the circular direction 104 to establish exchange-bias. However an additional post-deposition anneal in the presence of an external magnetic field oriented in the plane of the ferromagnetic layer 172 and in the circular direction 104 may be desirable since it may increase the bias field $H_{Ex}$.

If the optional coils 155-157 are used the structure 110 may fabricated by wrapping coil wire around the legs 131-133, respectively, or by using known thin film deposition and photolithographic techniques to pattern coil sections around the legs, in the manner similar to techniques used to fabricate thin film coils in magnetic recording disk drive thin film inductive write heads. Also, the coils 155-157 and current sources 165-167 may be used to provide the external magnetic field to set the circular in-plane magnetization direction for ferromagnetic layer 172, in the manner as described above.

Figure 4:
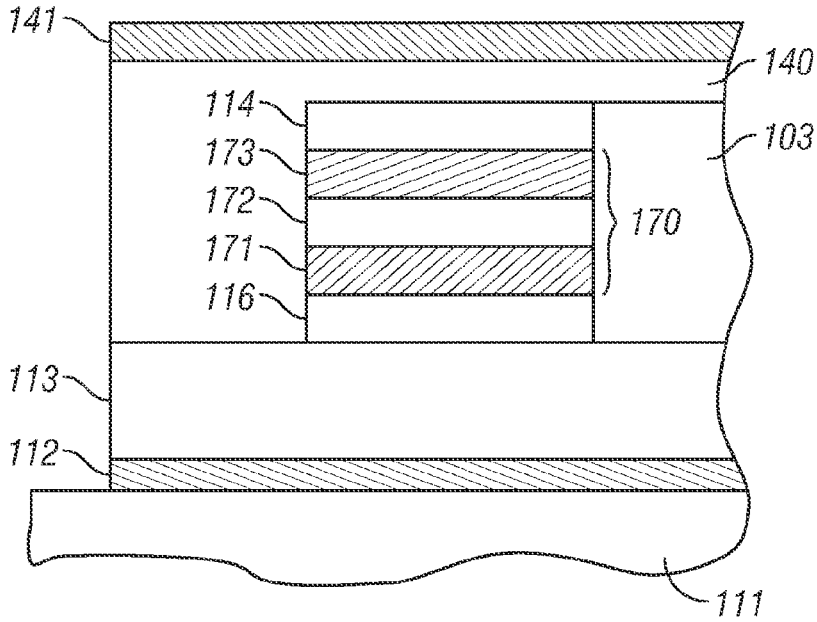
FIG. 4 is a sectional view of section B-B' of FIG. 2A and shows the connection of one of the stripline ports to the triangular-shaped circulator of this invention.

FIG. 4 is a sectional view of section B-B' of FIG. 2A for showing the connection of the stripline conductors, like stripline conductor 103, to the multilayered structure 110 that contains the exchange-coupled structure 170.

In the absence of an external applied magnetic field, such as would be applied by optional coils 155-157 connected to respective current sources 165-167, the ferromagnetic resonance (FMR) frequency of the multilayered structure 110 is determined by the properties of the material of ferromagnetic layer 172, such as its saturation magnetization ($M_S$), the anisotropy fields ($H_A$), and exchange-bias field ($H_{EX}$) due to the exchange-coupling to the antiferromagnetic layers 171, 173. However, if one or more of the optional coils 155-157 connected to respective current sources 165-167 is used, then the FMR frequency can be tuned by the externally applied field H. Assuming that the easy axis of magnetization is along the ring or triangle defined by the legs 131-133, i.e., in the circular direction 104, then the FMR frequency ($f_R$) is given by:

$$f_R = \frac{g}{2\pi}\sqrt{(H + H_A \pm H_{EX})(H + H_A \pm H_{EX} + 4\pi M_S)} \qquad \text{Eq. (2)}$$

where g is the gyromagnetic ratio, $H_A$ and $H_{EX}$ are the uniaxial anisotropy and unidirectional exchange-bias fields, respectively, and $M_S$ the saturation magnetization of ferromagnetic layer 172. The uniaxial anisotropy field $H_A$ is made up of various contributions such as the shape anisotropy, possible magnetocrystalline anisotropy, and the rotatable anisotropy due to the exchange-bias to the antiferromagnets. The rotatable anisotropy has its origin in ferromagnetic grains magnetically coupled to rotatable antiferromagnetic grains. The rotatable anisotropy can constitute a significant portion of $H_A$.

Due to the unidirectional character of the exchange-bias the resonance frequency $f_R$ will be different along and opposite to the exchange-bias direction. Thus, for example, if the exchange-bias direction is set in the CW direction (arrow 104 in FIGS. 2A-2B), a microwave signal traveling in the CW direction will encounter maximum attenuation at a different frequency than a microwave signal traveling in the CCW direction.

Figure 5:
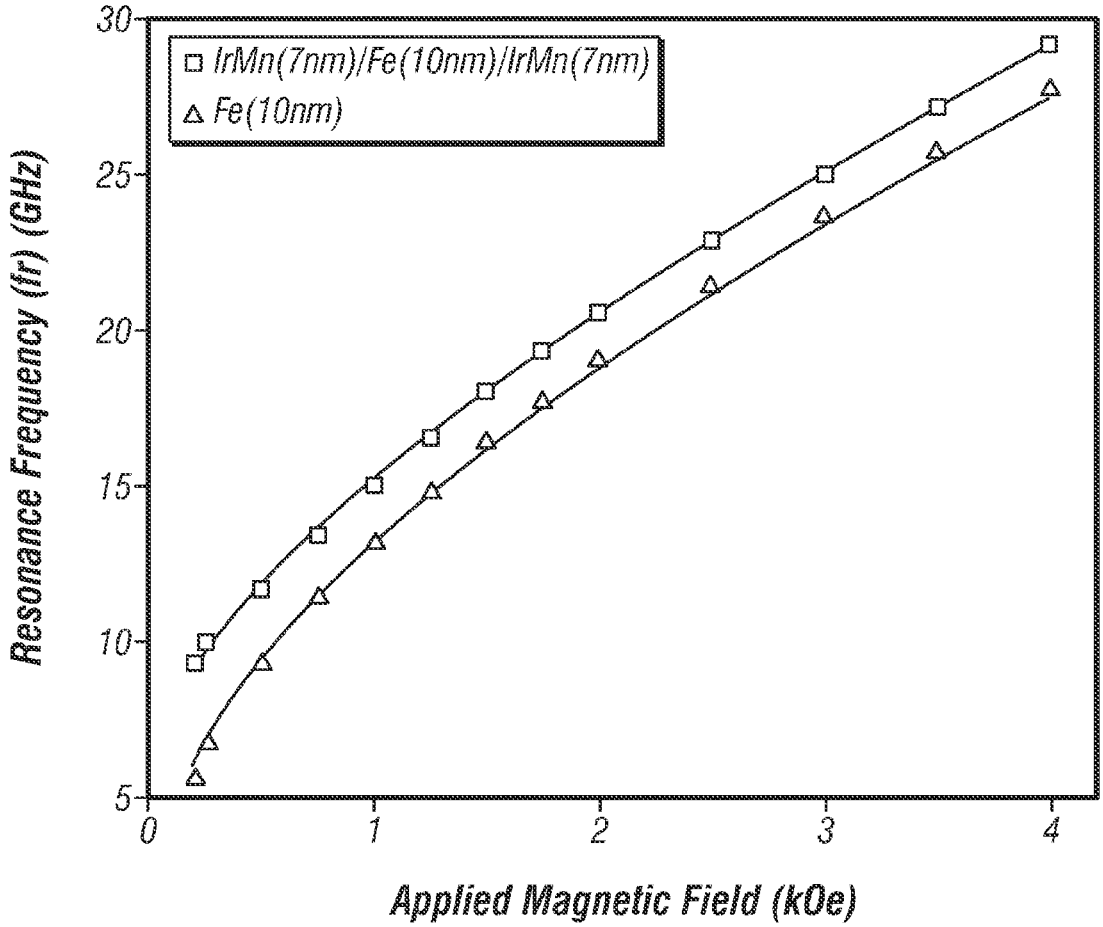
FIG. 5 is a graph of ferromagnetic resonance (FMR) frequency $f_R$ as a function of applied magnetic field for a Fe(10 nm) control film and a IrMn(7 nm)/Fe(10 nm)/IrMn(7 nm) exchange-biased structure according to the invention.

FIG. 5 is a graph of FMR resonance frequency $f_R$ as a function of applied external magnetic field for a Fe (10 nm thick) control film and a IrMn(7 nm)/Fe(10 nm)/IrMn(7 nm) exchange-biased structure 170. Without an external field, $f_R$ is about 5.5 GHz for the Fe control film, and about 9 GHz for the exchange-biased structure. The increased frequency for the exchange-biased structure originates from the exchange and rotatable anisotropies induced by the exchange-bias. It has also been determined experimentally, from scattering parameter data as a function of applied field, that the resonance frequency linewidth decreases with increasing external magnetic field, for example at 0.2 kOe the linewidth is about 5 GHz, whereas at 1 kOe the linewidth is about 2.5 GHz. Thus for a narrow linewidth, the use of the optional coils 155-157 with current sources 165-167 may be desirable to apply an external magnetic field. By changing the strength of the external field the FMR and thus the operating frequency of the circulator can be tuned. This is an advantage over prior art circulators utilizing ferrite slabs where the operating frequency is determined and fixed by the material properties of the ferrite.

For example, if the exchange-bias direction is established in a CW direction 104 as shown in FIGS. 2A-2B, then the resonance frequency for microwaves travelling around the structure 110 in a CW direction is:

$$f_{R+} = \frac{g}{2\pi}\sqrt{(H + H_A + H_{EX})(H + H_A + H_{EX} + 4\pi M_S)} \quad \text{Eq. (3)}$$

and the resonance frequency for microwaves travelling around the structure 110 in a CCW direction is:

$$f_{R-} = \frac{g}{2\pi}\sqrt{(H + H_A - H_{EX})(H + H_A + H_{EX} - 4\pi M_S)} \quad \text{Eq. (4)}$$

A signal entering the circulator at frequency $f_{R+}$ via stripline 101 in transmission mode will pass in the CW direction via stripline 102 to the antenna. A signal entering the circulator via stripline 102 in receiving mode will pass in the CW direction via stripline 103 to the receiver. A signal entering the circulator at frequency $f_{R-}$ will be passed in a CCW direction. Signals far enough outside the frequency bands around $f_{R+}$ or $f_{R-}$ will not be passed.

Since the current sources 165-167 can generate different amounts of electrical current to respective coils 155-157, different magnetic fields can be generated in the different legs 131-133. Thus the resonance frequencies in each part of the circulator can be different. Accordingly, the frequency for transmitting signals from the transmitter via striplines 101 and 102 to the antenna may be different from the frequency for receiving signals from the antenna via striplines 102 and 103 to the receiver. If it is not desired to be able to selectively change the resonance frequencies in the individual legs, then a single coil can be wrapped around the entire triangular-like or ring-like structure and connected to a single current source.

If one of the ports of the circulator is terminated in a matched load, the circulator can be operated as an isolator. Then a signal at frequency $f_{R+}$ or $f_{R-}$ can only travel in one direction between the two remaining ports. For example, if a matched load is connected to stripline 103, then a signal can travel at frequency $f_{R+}$ from port 101 to port 102 and a signal at frequency $f_{R-}$ from port 102 to port 101. Signals far enough outside the frequency bands around $f_{R+}$ or $f_{R-}$ will not be passed.

While the present invention has been particularly shown and described with reference to the preferred embodiments, it will be understood by those skilled in the art that various changes in form and detail may be made without departing from the spirit and scope of the invention. Accordingly, the disclosed invention is to be considered merely as illustrative and limited in scope only as specified in the appended claims.

What is claimed is:

1. A circulator for directing a microwave signal comprising:

first and second ground planes of electrically conductive material;

a multilayered structure shaped as a continuous closed loop and comprising a ferromagnetic layer having an in-plane magnetization oriented generally around the loop of the structure, and an antiferromagnetic layer exchange-coupled with the ferromagnetic layer for providing an exchange-bias field to the ferromagnetic layer, the multilayered structure located between the first and second ground planes; and a plurality of ports spaced around the loop and connected to the multilayered structure.

2. The circulator of claim 1 wherein the ferromagnetic layer comprises an alloy of Co and Fe.

3. The circulator of claim 1 wherein the ferromagnetic layer consists essentially of Fe.

4. The circulator of claim 1 wherein the antiferromagnetic layer is selected from the group consisting of a cobalt oxide, a nickel oxide, and an oxide of an alloy of cobalt and nickel.

5. The circulator of claim 1 wherein each of the first and second ground planes comprises a layer consisting essentially of Cu.

6. The circulator of claim 1 wherein the antiferromagnetic layer is a first antiferromagnetic layer in contact with one surface of the ferromagnetic layer and further comprising a second antiferromagnetic layer in contact with the other surface of the ferromagnetic layer for providing an exchange-bias field to the ferromagnetic layer.

7. The circulator of claim 1 wherein the multilayered structure has a generally triangular shape with three interconnected legs.

8. The circulator of claim 1 wherein the multilayered structure has a generally annular shape with three interconnected legs.

9. The circulator of claim 1 wherein the portions of the multilayered structure between the ports are legs and further comprising an electrical current source and an electrically conductive coil wrapped around the leg and coupled to the current source, wherein the energized coil provides a magnetic field along the leg coincident with the magnetization of the ferromagnetic layer.

10. The circulator of claim 1 wherein the antiferromagnetic layer is an alloy comprising Mn and at least one element selected from the group consisting of Pt, Rh, Ni, Fe, Ir and Pd.

11. The circulator of claim 10 wherein the antiferromagnetic layer comprises an alloy of Mn and Ir.

12. A circulator for directing a microwave signal comprising:

first and second ground planes of electrically conductive material;

a multilayered structure formed as a continuous closed loop and having a shape selected from a generally triangular-like shape and a generally ring-like shape, the structure comprising a ferromagnetic layer having an in-plane magnetization oriented generally around the loop of the structure, and an antiferromagnetic layer exchange-coupled with the ferromagnetic layer for providing an exchange-bias field to the ferromagnetic layer, the multilayered structure located between the first and second ground planes; and a plurality of electrically conductive ports connected to the multilayered structure, the ports being connected to the multilayered structure at the vertices of the triangle if the structure has a triangular-like shape and at generally equally angularly spaced locations on the ring if the structure has a ring-like shape, wherein the structure thereby has legs between the ports;

an electrically conductive coil wrapped around the legs; and an electrical current source coupled to the coil for energizing the coil to generate a magnetic field in the plane of the ferromagnetic layer and around the loop.

13. The circulator of claim 12 wherein the coil comprises a plurality of coil segments, each coil segment being wrapped around an associated leg, and further comprising one or more additional electrical current sources, each current source being coupled to an associated coil segment.

14. The circulator of claim 12 wherein the ferromagnetic layer is a material selected from Fe and an alloy comprising Co and Fe.

15. The circulator of claim 12 wherein the antiferromagnetic layer is selected from the group consisting of a cobalt oxide, a nickel oxide, an oxide of an alloy of cobalt and nickel, and an alloy comprising Mn and at least one element selected from the group consisting of Pt, Rh, Ni, Fe, Ir and Pd.

16. The circulator of claim 12 wherein each of the first and second ground planes comprises a layer consisting essentially of Cu.

17. The circulator of claim 12 wherein the antiferromagnetic layer is a first antiferromagnetic layer in contact with one surface of the ferromagnetic layer and further comprising a second antiferromagnetic layer in contact with the other surface of the ferromagnetic layer for providing an exchange-bias field to the ferromagnetic layer.

18. The circulator of claim 12 wherein one of the ports of the circulator is terminated in a matched load, whereby the circulator is operable as an isolator.

* * * * *